US006289762B1

(12) United States Patent
Silva

(10) Patent No.: US 6,289,762 B1
(45) Date of Patent: Sep. 18, 2001

(54) PEDAL MECHANISM

(75) Inventor: Peter Silva, High Wycombe - Bucks (GB)

(73) Assignee: Caithness Development Limited (GB)

( * ) Notice: Subject to any disclaimer, the term of this patent is extended or adjusted under 35 U.S.C. 154(b) by 0 days.

(21) Appl. No.: 09/358,332

(22) Filed: Jul. 21, 1999

(30) Foreign Application Priority Data

Jul. 21, 1998 (GB) ..... 9815705

(51) Int. Cl.[7] ..... G05G 1/14
(52) U.S. Cl. ..... 74/513; 74/560
(58) Field of Search ..... 74/513, 514, 512, 74/560

(56) References Cited

U.S. PATENT DOCUMENTS 5,063,811 * 11/1991 Smith et al. ..... 74/513
5,507,201 * 4/1996 Fairbairn et al. ..... 74/513
6,070,490 * 6/2000 Aschoff et al. ..... 74/513

FOREIGN PATENT DOCUMENTS

3634003 * 4/1988 (DE) ..... 74/512
4426549 2/1996 (DE) .
4300096 2/1998 (DE) .

OTHER PUBLICATIONS

Search Report for Application No. GB 9815705.0, The Patent Office, Dec. 10, 1998.

* cited by examiner

*Primary Examiner*—Mary Ann Green
(74) *Attorney, Agent, or Firm*—Bourque & Associates, P.A.

(57) ABSTRACT

A pedal mechanism requires a friction mechanism for producing the force hysteresis in the pedal to ensure the correct, desirable pedal 'feel'. The friction is produced with a pivoted friction arm 28 which is urged into frictional contact with the pedal arm 18 by resetting springs 32,34.

17 Claims, 5 Drawing Sheets

PEDAL MECHANISM

FIELD OF THE INVENTION

This invention relates to a pedal mechanism. The invention is particularly, but not exclusively, intended for use in a motor vehicle, for controlling a function of the vehicle. In particular, the pedal may be an accelerator pedal.

BACKGROUND TO THE INVENTION

It is known to provide a connection between an accelerator pedal and a throttle plate of a throttle mechanism using a Bowden cable. The accelerator pedal can be formed in one or more parts and is conventionally mounted in a floor assembly of the driver cell of a motor vehicle. The throttle plate is opened by the driver's foot pressure on the accelerator pedal. One or two resetting springs are provided to draw the accelerator pedal and thus the throttle plate back to an idling position when the driver's foot is lifted. In this way a link is provided between the pedal and throttle plate position on the one hand and a change in the engine speed on the other hand.

As a result of the introduction of new combustion engines with improved exhaust and fuel consumption properties there is an increasing need to supply electronic engine systems with an electronic signal representing accelerator position. It is known to cause pedal movement to be converted into an electronic engine management signal This is often referred to as 'drive by wire'. However in order to produce the correct 'feel' which the driver is used to experience through the foot when driving a car with a Bowden cable linkage, it is necessary to produce, in a drive by wire system, a resistance to pedal movement which simulates the resistance and the same driving conditions which would have been produced using a cable linkage system.

Pedal mechanisms are known wherein the friction force is produced by means of separate pretensioned friction elements (e.g. DE 3 411 456 C2). Arrangements of this kind are complicated in construction and limiting for the size of the friction force. It is also important that if one spring breaks then a satisfactory and safe resetting must be possible. The safe resetting in the event of a spring breaking is an absolute necessity for reasons of product liability and is a legal requirement in the USA through safety standard FMVSS124.

There are already several proposals (e.g. DE 3 411 393 A1; EP A 0 092 640; WO A 89/07706; WO A 91/04165) where additional friction, spring and connecting elements are provided to produce the friction.

A arrangement is known from the German Patent Application DE 4 407 005 C1 where the friction is produced by pretensioning a friction mechanism through reset springs. A complicated large-scale transfer mechanism is used here and a radially displaceable wedge-shaped friction element is used to produce friction on a lever rigidly coupled to the pedal axis.

This arrangement requires several parts movable relative to each other and cannot be integrated in the pedal structure as a result of the large installation space required.

The invention therefore seeks to provide a pedal mechanism which transfers the pedal position simply and precisely to for example an electronic engine control unit whilst the driving feel remains unchanged compared to conventional regulating processes.

An object of the invention is to design a pedal mechanism so that the resetting force of the resetting elements is used directly to produce the friction force. Furthermore the friction mechanism is to be capable of integration in the pedal so that no additional structural or sealing elements are required to protect the friction mechanism from dirt. Furthermore the pedal bearing should be precise with neutral wear and able to be manufactured cost-effectively. The unavoidable wear to the highly-stressed friction faces producing the pedal friction required for reasons of comfort should not change the play or accuracy of the pedal mechanism throughout its service life.

SUMMARY OF THE INVENTION

According to the invention, there is provided a pedal mechanism comprising a pedal arm pivoted on a base, an auxiliary arm also pivoted on the base, on a pivot axis parallel to but spaced from the pedal arm axis, and biasing means acting between the base and the auxiliary arm, to bias the auxiliary arm into frictional contact with the pedal arm, and a sensor adapted to sense the position of the pedal arm and to output a pedal position signal.

The pivot axis of the pedal arm preferably lies between the pedal foot pad and the auxiliary arm pivot axis.

The auxiliary arm preferably has a friction enhancing surface where it makes contact with the pedal arm, and/or the pedal arm has a friction enhancing surface where it makes contact with the auxiliary arm.

The biasing means can comprise at least one helical compression spring tensioned between the auxiliary arm and the base. There may be two such springs arranged side by side with their ends supported in annular grooves. In another embodiment, the springs are fixed by retaining dome covers. The springs can be helical compression springs of different diameters with one spring fitted inside the other.

The base can be moulded from a plastics material such as glass fibre reinforced resin. The pedal arm and the auxiliary arm End stops for pedal arm movement can be mounted on the base, the end stops cooperating with a part of the pedal arm which lies on the opposite side of the pedal arm axis to the foot pad. The end stops can consist of an elastic noise-damping material.

The pedal position sensor can be mounted on the base adjacent the end stops, and can be mounted to enable it to be rotated to set an accurate rest position. The base can have a screw-on flange for holding the position sensor.

The pedal mechanism can include a device (eg a kick-down device) for producing a rise in the pressure required to depress the pedal arm, over part of the pedal arm travel. The device can be located in a recess in the pedal arm.

The pedal mechanism can be specifically adapted to function as an accelerator pedal mechanism, for a motor vehicle.

BRIEF DESCRIPTION OF THE INVENTION

The invention will now be further described, by way of example, with reference to the accompanying drawings, in which.

The same or similar-acting parts are provided with the same reference numerals in all the Figures.

DESCRIPTION OF PREFERRED EMBODIMENTS

The drawings show an accelerator pedal mechanism with an integrated position sensor for controlling the power of a drive machine. The drive machine can be an electric, petrol or diesel engine.

Figure 1:
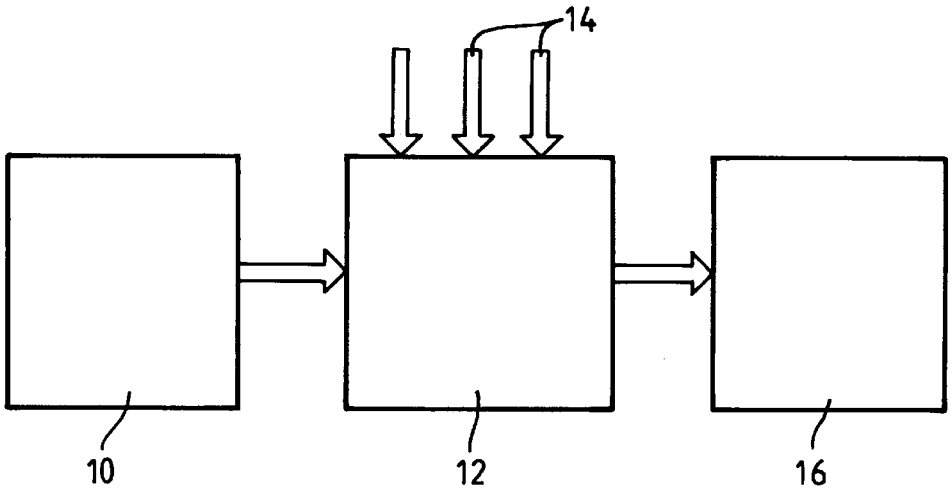
FIG. 1 is a block diagram showing a control system within which the pedal of the invention can be used as an accelerator pedal.

In FIG. 1, the block 10 represents a sensor module which senses the pedal position. This module generates a signal representing pedal position which is passed to an engine control module 12. The module 12 also receives other signals 14 from other sensors representing eg engine coolant temperature, ambient temperature, manifold vacuum. The module 12 evaluates all these signals and then produces an output signal which is fed to a throttle valve unit 16, or to a fuel injection pump in the case of a diesel engine.

The pedal mechanism has a swivel pedal arm 18 which can swivel about a swivel axis 20 at one end and has a pad 22 for contact with the driver's foot at the other end. The pedal can be moved against a rising resetting force, produced by two resetting springs, from a rest position (FIG. 2—idle position) into an end position (FIG. 3—wide open throttle).

Figure 2:
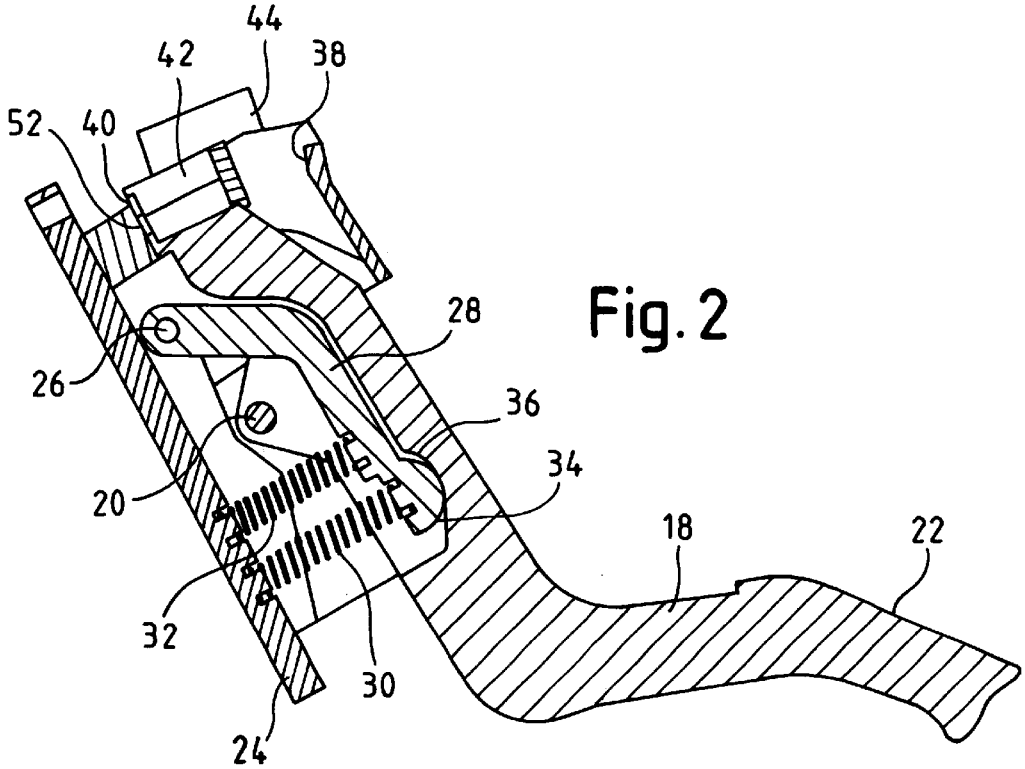
FIG. 2 is a cross-section through a pedal mechanism in accordance with the invention, in the idle position.
Figure 3:
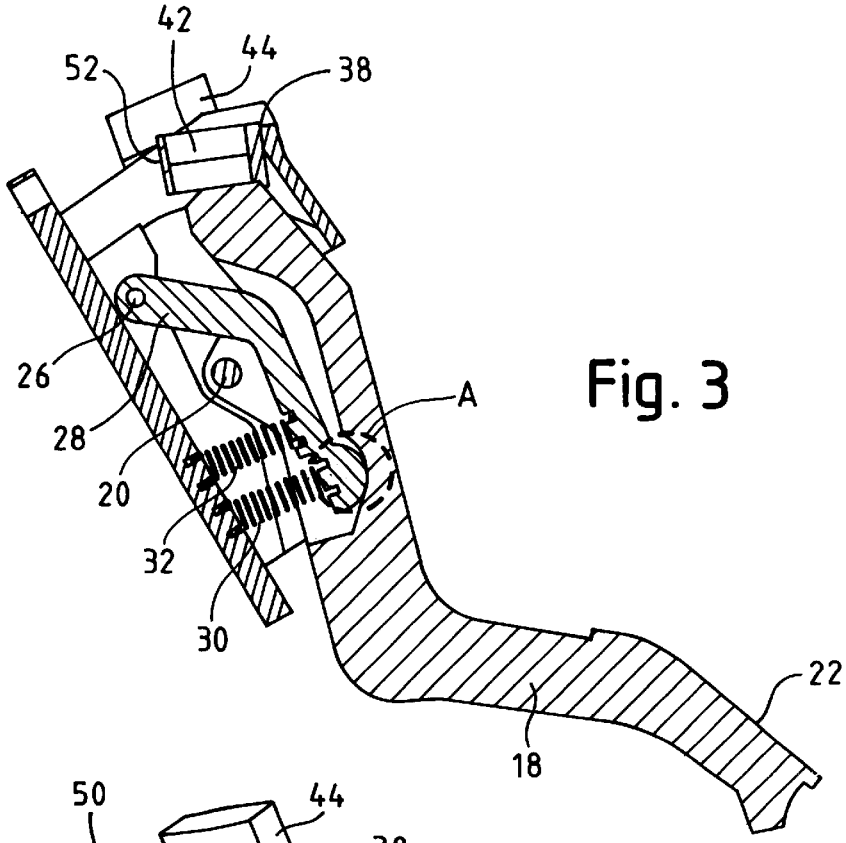
FIG. 3 is a cross-section corresponding to FIG. 2, but showing the pedal in the wide open throttle position.

FIG. 2 shows a base 24 in which the pedal arm 18 is mounted to pivot about the pedal axis 20. The base also has a pivot axis 26 for an auxiliary or friction arm 28. Resetting elements in the form of helical compression springs 30,32 are mounted between the base 24 and the friction arm 28 so that the friction arm is always urged in the direction of the rest position of FIG. 2. The friction arm 28 has a friction surface 34 which is pressed against the underside of the pedal arm 18, at a region where the pedal arm also has a friction surface 36.

Because the pivot points of the friction arm 28 and the pedal arm 18 are spaced from one another, when the pedal arm is depressed by the driver's foot, the springs 30, 32 are compressed and relative movement takes place between the friction surfaces 34, 36. This relative movement produces in conjunction with the pretension provided by the reset springs 30,32 a friction force which is proportional to the force imposed on the pedal by the springs.

Figure 6:
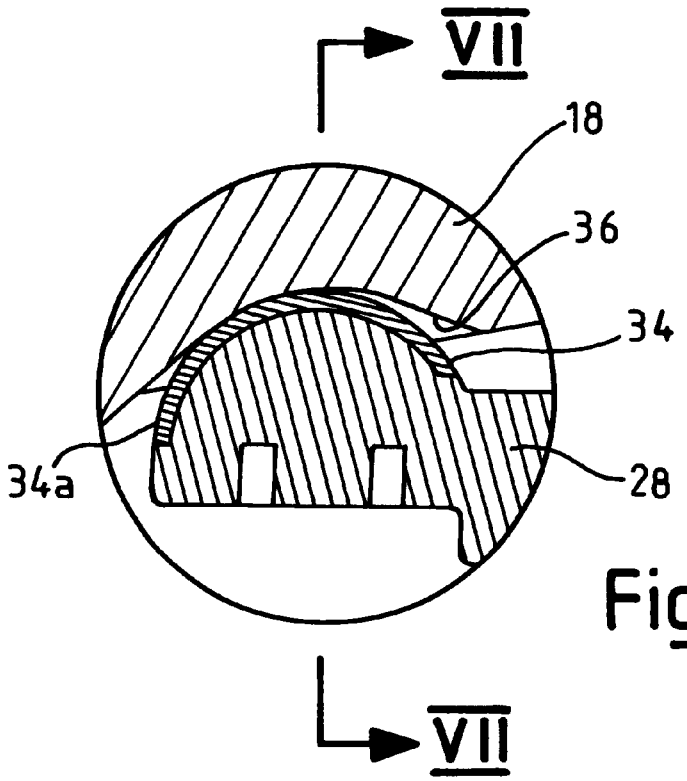
FIG. 6 is a cross-section, on a larger scale, taken in the circle A from FIG. 3.

The friction force is dependent on the pretension force of the reset springs 30,32, the engagement angle $\alpha$ between the pedal arm 18 and the friction arm 28 and on the coefficient of friction ($\mu$) between the friction arm and the pedal arm. The pretension force of the resetting spring elements 30,32 and the force components of the friction force acting tangentially to the pedal axis 20 produce the pedal moment. FIG. 6 shows that the friction arm 28 can have a special friction modified coating at 34*a*, just on the surface of the arm which makes contact with the underside of the pedal arm 18.

Figure 7:
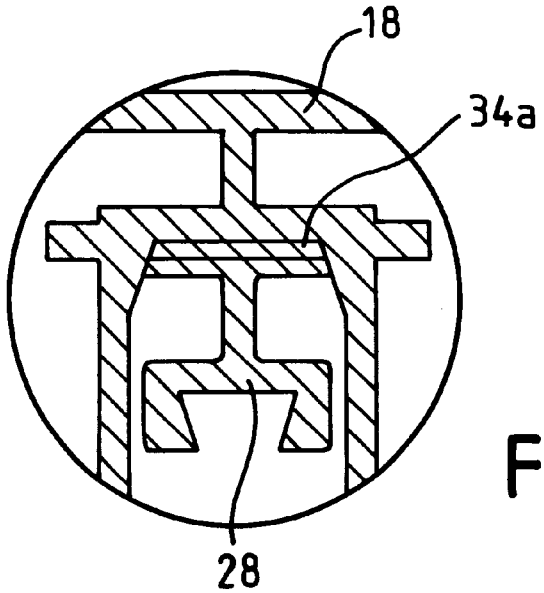
FIG. 7 is a cross-section taken on the line VII—VII from FIG. 6.

The shape of the end of the friction arm 28 is also apparent from FIG. 7 which shows that, at any particular point of the relative movement between the two arms, there will be line contact between the two curved surfaces which have different radii of curvature.

A pedal mechanism as described above can have in particular the following advantages:

The friction-producing normal force is produced by the reset springs 30,32. Thus if one reset spring breaks then the friction is also reduced and thus a safe return of the pedal as required by American safety standards FMVSS124, is always guaranteed. This allows the pedal mechanism to be designed with a very large force hysteresis (friction) which is very advantageous for reasons of driving comfort.

For producing friction only one additional component part (auxiliary arm 28) is required which can be integrated very easily in the pedal assembly through suitable geometry. The pedal mechanism requires very few component parts.

Figure 5:
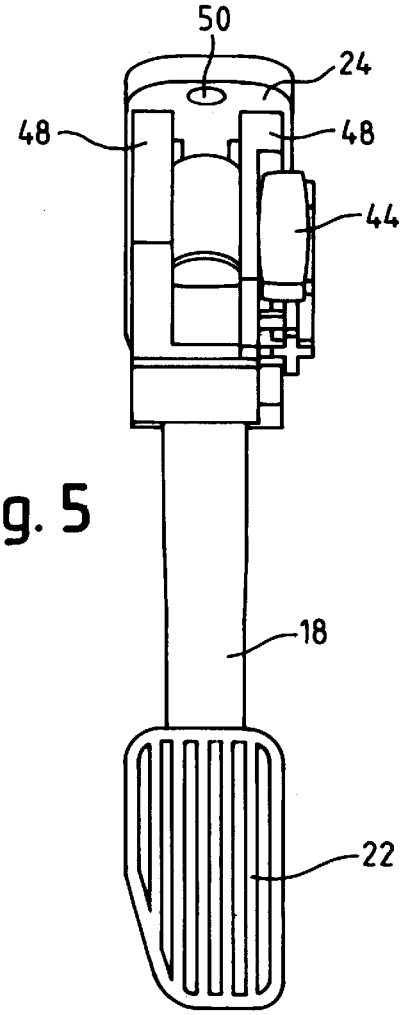
FIG. 5 is a front elevation of the pedal mechanism.

The design of the friction elements allows the pedal to be positioned centrally relative to the pedal bearing (see FIG. 5). In conjunction with a suitably designed pedal base 24 it is thereby possible to avoid torsional forces in the pedal mechanism, which results in a high pedal stiffness. This is a necessary prerequisite so that the pedal mechanism can be made completely from a plastics material such as glass fibre reinforced plastics which for reasons of cost and weight is a definite advantage for large scale mass production in the automobile industry.

The compact construction with a central pedal bearing allows the pedal mechanism to withstand forces which may occur during mis-use of the pedal, such as may arise during panic-acceleration, or by the driver changing seat position whilst resting a foot on the accelerator pedal. A full load stop 38 can be incorporated into the pedal mechanism. In conjunction with an idling position stop 40 likewise integrated in the pedal mechanism, the pedal mechanism can be formed as a fully pre-adjusted unit which requires no additional adjustment on the part of the vehicle manufacturer during installation into the vehicle whilst maintaining the smallest possible tolerances for pedal travel and the spatial position of the pedal in the vehicle (particularly important here is the vertical clearance between the accelerator pedal and the foot brake). Since any adjustment work has to be carried out in the poorly accessible floor space area of the vehicle the avoidance of any need for adjustment means a considerable improvement in the quality with at the same time not inconsiderable cost savings during the fitting of the pedal mechanism in the vehicle.

The design described allows a solid plastics structure of the pedal mechanism. In addition to the known advantages such as production of ready finished individual parts through injection moulding, there is no need for paint-spraying etc since the entire pedal mechanism can be adapted to the visual needs of the customer and no special pedal covers such as e.g. rubber plates for the pedal plate are required since this can be integrated in each desired design directly into the pedal.

The bearing points required for the pedal arm and the auxiliary arm can be designed as so-called direct plastics bearings so that no additional bearing sleeves of special plastics or self-lubricating compound bearing materials which are used nowadays in pedal bearings are necessary.

Figure 11:
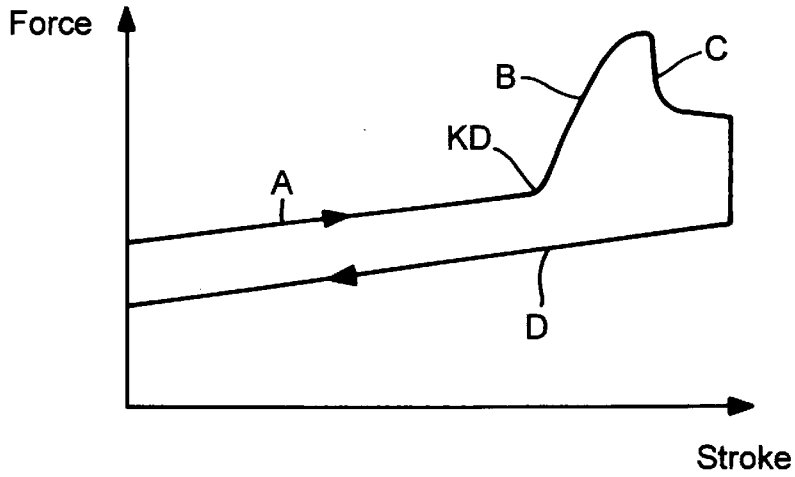
FIG. 11 is a plot of force against pedal stroke.

In order to produce a force jump during the kick-down function as shown in the diagram in FIG. 11, the design of the pedal mechanism with a ribbed plastics pedal or alternatively of a hollow box profiled section which can be produced for example through injection moulding in an internal pressure process allows an optional fitting with a mechanical kick-down element in a socket 42 provided for this purpose in the pedal arm. This kick-down functional unit can be mounted in the socket shown in the pedal arm, or in the base. This allows a modular construction of the pedal mechanism which can be adapted through simple assembly of an additional component part to the different requirements for manual and automatic transmissions. A further possibility is provided of fitting the kick-down function unit under the operating part of the pedal arm in a suitably designed socket. This has the advantage that a very precise operation of the kick-down element can be produced with a steep force rise. Since the existing elasticity of the pedal is very slight as a result of the short free pedal arm length, the pedal force rise of the kick-down unit according to FIG. 11 is not flattened out by the pedal elasticity.

Figure 8:
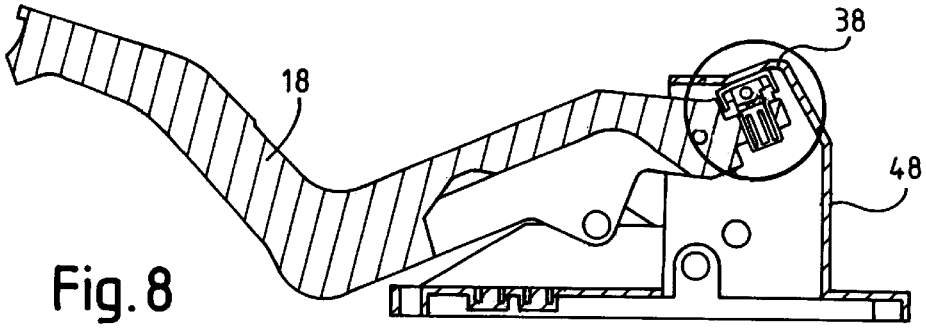
FIG. 8 shows an alternative form of end stop for the wide open throttle end of pedal movement.
Figure 9:
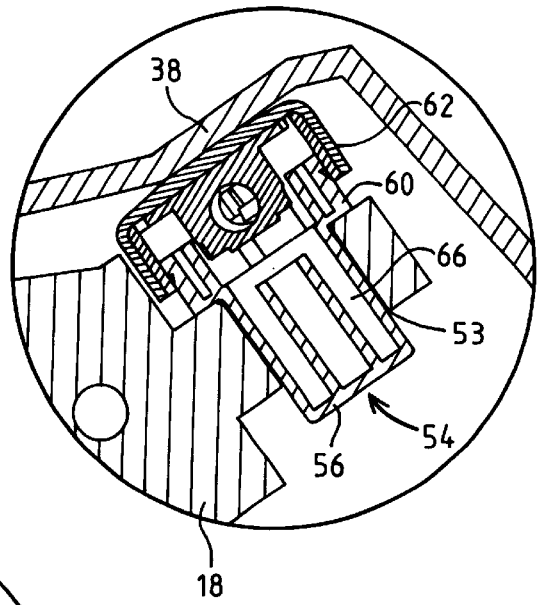
FIGS. 9 and 10 show a kick-down switch in the unoperated and in the operated positions.
Figure 10:
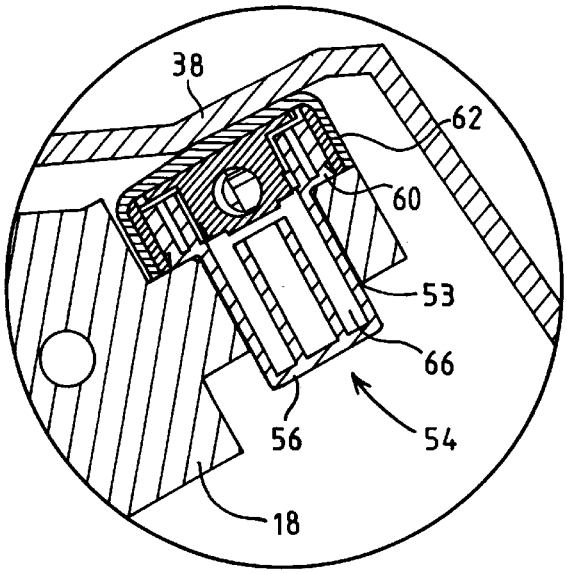

FIGS. 8, 9 and 10 show a kick-down mechanism and the way in which this also acts as an end stop to limit pedal travel against the restoring force of the springs 30,32. The pedal arm 18 here has a socket 53 at right angles to the pedal pivot axis. In this socket, a kick-down spring unit 54 is fitted. This unit provides the extra resistance to pedal depression which signals to the driver that kick-down is being activated. The unit 54 has a base 56 with a shoulder 60 which fits inside the socket in the pedal arm. A cap 62 fits onto the base and is normally biased upwards, away from the base, to the position shown in FIG. 9. A coil spring (not shown) is fitted in a recess 66 to do this. When the kick-down position is reached, the cap 62 contacts the end stop 38 on an inner surface of the housing 48. To move the pedal further requires the driver to overcome not only the resistance of the springs 30, 32 and the friction between the pedal and friction arms, but also to compress the spring in the recess 66.

When the pedal is fully compressed, the cap 62 reaches the position shown in FIG. 10, and this acts as a full-load stop for the pedal movement.

The pedal mechanism is shown fitted with two helical or coil compression springs 30,32. Springs of this kind can be made cost-effectively and with great precision. In conjunction with the generation of friction through the friction arm 28 it is possible to produce a pedal operating force and pedal friction with very great precision without additional pretensioning elements and without the need for an adjustment, which is very advantageous for large scale mass production. With a view to the rising demands for comfort in the automotive industry this design of pedal mechanism offers through the optimum design of the driver/vehicle interface with regard to the ergonomic design and behaviour of the pedal considerable advantages over the prior art, where the friction is generally produced with additional friction and pretensioning elements, and thus has great tolerances.

Through an integrated friction mechanism a friction force is produced which is dependent on the resetting force of the pedal mechanism and is required for a comfortable ergonomic pedal operation and to produce a pedal characteristic line according to FIG. 11. The pedal mechanism can optionally be provided with a kick-down unit, which produces a force rise according to the diagram shown in FIG. 11 (FIG. 11 area B) and the force drop after overcoming the force peak (FIG. 11 area C).

The stages shown in FIG. 11 are:

| | |
|---|---|
| A | Operating Force |
| KD | Kick-down activation |
| B | Kick-down force increase |
| C | Kick-down force drop after overshooting the threshold |
| D | Holding Force |
| A-D | Pedal force hysteresis |
| Peddal force hysteresis | 2 * pedal friction torque/pedal radius |

The desirable characteristics are achieved in the pedal mechanism described here in that:

The assembly base 24 has a separate precise and very stable pedal bearing which advantageously can be designed as a solid plastics bearing;

The assembly base 24 has a friction arm 28 mounted outside of the pedal bearing 20 and biased with force through the resetting springs 30,32;

The friction arm 28 is pressed by means of the resetting springs 30,32 against a specially designed friction face 36 of the pedal arm 18;

Through the separate bearing 26 of the friction arm 28 spaced from the pedal bearing 20, a relative movement is produced between the pedal arm and friction arm to produce a friction force which is dependent on the resetting force.

The pedal bearing and the friction arm bearing can be formed by plastics pins inserted through matching holes on opposite sides of the pedal housing 48. Another similar pin can be inserted through holes on opposite sides of the housing to form an end stop for the pedal at the idle end of its travel.

The pedal operating force which can be felt by the driver corresponds to the pedal force divided by the active pedal radius. Thus in the operating direction the driver feels the pedal resetting force produced by the resetting elements, the resetting force plus the tangentially acting friction force components and in the direction of reducing acceleration or holding the accelerator pedal position the driver feels the pedal force produced by the resetting elements minus the tangentially acting friction force components since the friction force always acts against the direction of movement.

By applying a large friction force it is thus possible to significantly reduce the force required to maintain the position of the pedal. Since this prevents the foot from tiring over longer journeys a large pedal friction is found to improve comfort.

Using the resetting elements shown to produce the friction force allows the pedal operating and holding forces to be produced solely from ergonomic points of view. If a resetting element should fail, the pedal friction will be reduced at the same time so that safe resetting of the pedal in the event of a break in one resetting element is ensured. This is also in part a legal requirement (e.g. in the USA through FMVSS 124).

Furthermore only one additional component part (friction arm 28) is required to produce the pedal friction. This allows a very simple and extremely robust lightweight space-saving design of the pedal mechanism.

A solid plastics construction of a pedal mechanism is illustrated in the examples. The design of the friction arm and the integration thereof into the pedal structure allows an extremely stiff structure which is extremely lightweight and suited to plastics. The weight of this structure can amount to about 250 g. Comparable structures with steel pedal and adapted pedal sensor which are generally used nowadays are significantly heavier and on average weigh about >750 g.

By applying a specific friction lining to the surfaces 34,36, ie the contact faces between the pedal arm and friction arm it is readily possible through a corresponding choice of material to adapt the friction values and thus the friction force. Since the friction lining in the pedal has a small area and a small volume and does not have to absorb pedal forces, relatively expensive friction-modified special plastics can be used here which are best suited for this use and guarantee a defined quiet stick-slip-free friction which is constant throughout the service life and requires no lubrication.

The resetting elements are illustrated by two coil compression springs 30,32. They can be made cost-effectively with high precision. When designed in stainless valve spring steel (as is preferred), calculation and construction for permanent strength are possible without problem.

In order to minimise in particular the width of the structural space required the coil compression springs are mounted side by side and fixed in ring-shaped recesses in the friction arm 28 and in the assembly base 24. Alternatively there is the possibility of boxing the two coil compression springs one inside the other (small spring in large spring). Fixing the large outer spring can then be through a ring-shaped recess in the friction arm and in the assembly base. The smaller inner spring is then fixed on retaining pins in the assembly base and on the friction arm.

The pedal arm is designed as a one-piece plastics part 18 including a recess 42 for optional fitting with a kick-down element and a pedal position sensor 44. In a design using a solid plastics structure the sensor 44 can be adapted in shape and design without additional costs in an optimum manner to customer requirements.

Figure 4:
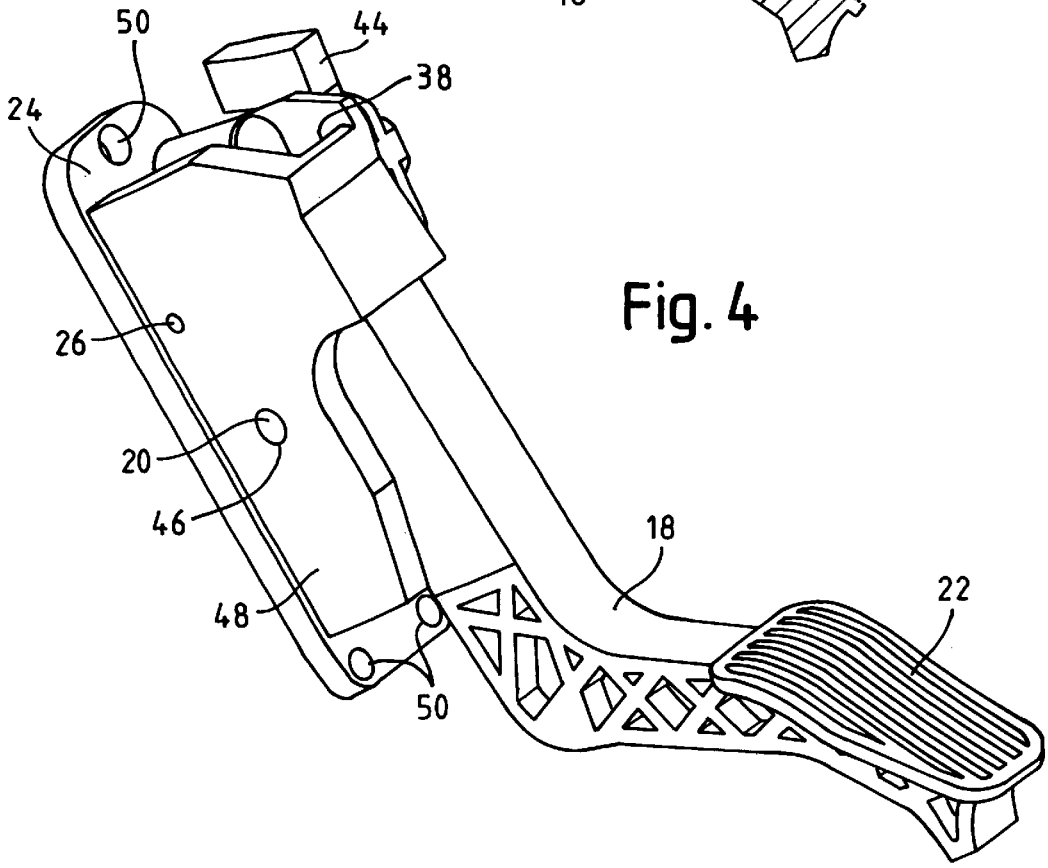
FIG. 4 is a perspective view of the pedal mechanism of the invention.

FIGS. 4 and 5 show a foot or pedal pad 22 which has a ribbed design combined with a slightly rounded pedal contour which produces an optimum ergonomic pedal shape. The openwork structure indicated, by avoiding large wall thickness, allows reliable manufacture in an injection moulding process with maximum stiffness and lowest possible weight. This structure could be optimised by finite element analysis so that for each different design, accurately defined boundary values can be given for permanent and peak load.

The pedal arm 18 is carried on a bearing shaft 20 which is set in a bore in the pedal arm and in bores 46 in side walls 48 of the assembly base 24. As this shaft does not have to rotate it can be made from either steel or plastics (e.g. as an injection-moulded part). When made from steel the bolt is advantageously milled on one side and has a pressed seat in the assembly base. The bore in the pedal arm is formed with clearance. With the cost-effective design of the bearing bolt as an injection moulded plastics part the fittings in the pedal arm 18 and in the assembly base 24 are designed as clearance fittings. The axial fixed seat of the bearing bolt is ensured through a radially mounted detent nose (not shown) on the bearing bolt which engages in a recess (not shown) in the pedal arm.

The position sensor 44 is for reasons of bearing precision and standardisation formed as a separate component part with its own bearing and its own housing. It is screwed by means of screws onto correspondingly formed screw-on dome covers of the assembly base and is adjusted through screw-on flange bores formed as oblong holes in the rest position to an accurately specified starting signal through turning and then screw-tightening. The mechanical transfer of the pedal travel by the position sensor takes place through a conventional lever mechanism or spur wheel gearing.

The assembly base has a plastics flange in which corresponding assembly bores 50 are provided which are readily accessible from above. It is advantageous if threaded bolts are prefixed on the vehicle body structure so that during assembly the pedal mechanism is already pre-centred. So that it becomes possible, for reasons of weight and costs, to dispense with the present day conventional metal sleeves in the assembly bores which are to prevent overstraining the plastics during screw-tightening, so-called squeeze nuts are used for fitting. It is thus possible to secure the pedal mechanism by tightening the nuts to a predetermined torque which guarantees a reliable fixed seat of the pedal mechanism but does not overstrain the glass fibre reinforced plastics in the area of the screw-in bores. Despite the unavoidable break-down of the pretension through the flow of plastics in the flange area of the assembly base a safe seat of the pedal mechanism is ensured through the existing residual tension and loosening of the screws is prevented by the radial pretension which exists in the squeeze nuts.

The stop for the pedal travel in the rest or idle position is integrated through suitably designed faces into the pedal arm and assembly base 40,52. By making these parts as injection moulded parts the smallest possible tolerances are produced for the stop in the rest position. This has the advantage that with a corresponding tolerance provision in the vehicle the smallest possible bearing tolerances are produced for the spatial arrangement of the pedal mechanism in relation to the position of the brake. This has a significant qua advantage especially with high-performance vehicles since a more accurate vertical distance between the brake pedal and the accelerator pedal helps to avoid accidental simultaneous operation of the accelerator and brake pedal, and thus prevents the engine power overcoming the brake power and the vehicle from accelerating undesirably.

For the ergonomic foot operation it is necessary that the pedal travel of the pedal mechanism is not too great since otherwise for full throttle the foot moves into an unacceptably tiring stretched position or the heel of the foot has to be moved each time between idling and full load position. Thus a small pedal travel is required for the ergonomic foot design. On the other hand too small a pedal travel, particularly in the case of high performance vehicles, leads to poor throttling of the vehicle power. Many experiments have shown that a pedal travel of about 50 mm from idling to full load represents the best possible compromise between throttle control and pedal ergonomy. This means that an ideal pedal mechanism must have low tolerances for the pedal travel since otherwise the throttling or pedal ergonomy is negatively affected. The design of the pedal mechanism according to the invention therefore has the idling stop and full load stop integrated into the pedal mechanism. Since the tolerances for the pedal travel in the embodiment illustrated in FIG. 3 are produced substantially by the position of the integrated stops 38,40 in only two ready to use parts which can be made with high precision in the injection moulding process, the pedal arm 18 and assembly base 24, it is evident that low tolerances for the pedal travel can be produced without any subsequent adjustment required in the vehicle.

The critical point when integrating the full load stop into the pedal mechanism is that all the pedal forces which act on the pedal have to be absorbed solely through the pedal mechanism including its housing structure in the vehicle.

Since the accelerator pedal represents a safety-critical structural group it immediately follows from this that the pedal mechanism including its housing structure in the vehicle must have a very high rigidity and the load boundaries have to be clearly proved through calculation and guaranteed through precision defined processes in production.

With the structure described here, these requirements are taken into account in the design. The pedal lies centrally between two extremely stiff side walls 48 which form bearing positions. By avoiding torsional forces in the pedal and in the assembly base maximum stiffness is produced with the lowest possible weight. By means of a finite element analysis, a framework structure for the pedal can be optimised in the area of the operating part and a box structure can be optimised in the area of the bearing and friction mechanism.

The pedal mechanism described thus offers good 'feel' to the driver, together with low cost, low weight and accurate reliable performance.

What I claim is:

1. A pedal mechanism comprising a base, a pedal arm pivoted on the base and pivotable about a first pivot axis and having a pedal foot pad, an auxiliary arm pivoted on the base and pivotable about a second pivot axis parallel to but spaced from the first pivot axis, biasing means acting between the base and the auxiliary arm, to bias the auxiliary arm into sliding frictional contact with the pedal arm, and a sensor adapted to sense the position of the pedal arm and to output a pedal position signal.

2. A pedal mechanism as claimed in claim 1, wherein the pivot axis of the pedal arm lies between the pedal foot pad and the auxiliary arm pivot axis.

3. A pedal mechanism as claimed in claim 1, wherein the auxiliary arm has a friction increasing surface where it makes contact with the pedal arm.

4. A pedal mechanism as claimed in claim 1, wherein the pedal arm has a friction increasing surface where it makes contact with the auxiliary arm.

5. A pedal mechanism as claimed in claim 1, wherein the base is moulded from a plastics material.

6. A pedal mechanism as claimed in claim 1, wherein the pedal arm is moulded from a plastics material.

7. A pedal mechanism as claimed in claim 1, wherein the auxiliary arm is moulded from a plastics material.

8. A pedal mechanism as claimed in claim 1, for use as an accelerator pedal in a motor vehicle.

9. A pedal mechanism as claimed in claim 1, wherein the biasing means comprises at least one helical compression spring tensioned between the auxiliary arm and the base.

10. A pedal mechanism as claimed in claim 9, wherein the biasing means comprises two compression springs acting as reset springs arranged side by side with their ends supported in annular grooves.

11. A pedal mechanism as claimed in claim 1, including a device for producing a rise in the pressure required to depress the pedal arm, over part of the pedal arm travel.

12. A pedal mechanism as claimed in claim 11, wherein the device is located in a recess in the pedal arm.

13. A pedal mechanism as claimed in claim 1, wherein end stops for pedal arm movement are mounted on the base, the end stops cooperating with a part of the pedal arm which lies on the opposite side of the pedal arm axis to the foot pad.

14. A pedal mechanism as claimed in claim 13, wherein the end stops include an elastic noise-damping material.

15. A pedal mechanism as claimed in claim 13, wherein the pedal position sensor is mounted on the base adjacent the end stops.

16. A pedal mechanism as claimed in claim 15, wherein the base has a screw-on flange for holding the position sensor.

17. A pedal mechanism as claimed in claim 15, wherein the position sensor can be rotated to set an accurate rest position.

* * * * *